US005439562A

United States Patent [19]

Snyder et al.

[11] Patent Number: 5,439,562

[45] Date of Patent: Aug. 8, 1995

[54] ELECTROCHEMICAL DECONTAMINATION OF RADIOACTIVE METALS BY ALKALINE PROCESSING

[75] Inventors: Thomas S. Snyder, Oakmont, Pa.; Dwight Goad, Kingston, Tenn.

[73] Assignee: Westinghouse Electric Corporation, Pittsburgh, Pa.

[21] Appl. No.: 261,862

[22] Filed: Jun. 17, 1994

[51] Int. Cl.[6] ..... C25C 1/06

[52] U.S. Cl. ..... 204/1.5; 204/105 R; 204/109; 204/112

[58] Field of Search ..... 204/1.5, 105 R, 109, 204/112

[56] References Cited

U.S. PATENT DOCUMENTS

| | | | |
|---|---|---|---|
| 3,853,725 | 12/1974 | Skarbo | 204/112 |
| 3,891,741 | 6/1975 | Carlin et al. | 423/2 |
| 3,928,153 | 12/1975 | Gendron et al. | 204/112 |
| 4,395,315 | 7/1983 | Zambrano | 204/112 |
| 4,738,834 | 4/1988 | Moore et al. | 423/2 |
| 4,764,352 | 8/1988 | Bathellier | 423/10 |
| 5,156,722 | 10/1992 | Snyder et al. | 204/112 |
| 5,183,541 | 2/1993 | Snyder et al. | 204/105 R |
| 5,262,019 | 11/1993 | Snyder et al. | 204/105 R |

*Primary Examiner*—John Niebling
*Assistant Examiner*—Arun S. Phasge

[57] ABSTRACT

A novel method for decontaminating radio-contaminated nickel comprising, in an electrorefining cell having a semi-permeable membrane, cathodically depositing substantially contaminant-free nickel from an alkaline solution containing electrolyte, nickel ions, and radioactive ions. Preferably, the electrolyte solution is ammonium sulfate maintained at a pH of least about 10 (as measured at cell temperature). The electrorefining methods of the invention eliminate the need for separate dissolving and plating tanks, and may be operated by a single power source. These methods are particularly useful for remediating nickel contaminated by technetium, uranium and actinide metals.

20 Claims, 3 Drawing Sheets

ELECTROCHEMICAL DECONTAMINATION OF RADIOACTIVE METALS BY ALKALINE PROCESSING

BACKGROUND OF THE INVENTION

This invention relates generally to decontamination of radio-contaminated metals, and in particular to decontamination of radio-contaminated metals by alkaline electrochemical processing. Of particular interest to the present invention is the remediation of radio-contaminated nickel from decommissioning uranium gas diffusion cascades in which nickel is the primary constituent and technetium, neptunium, plutonium and uranium are the primary radioactive contaminants.

The radiochemical decontamination art is presented with unique practical problems not shared with traditional extraction technologies. For example, the presence of only residual parts per million concentrations of reactor fission daughter products such as technetium, neptunium, plutonium, and any other actinides, in remediated nickel and other like recycled products will so degrade product quality of remediated products that their release to unregulated non-nuclear markets is prevented. Degraded product must then either be employed in less valuable regulated nuclear markets or be reworked at greater financial cost.

Various decontamination processes are known in the art, and specifically for decontamination of nickel. Nickel can be removed by selectively stripping from an acidic solution by electrowinning. See U.S. Pat. No. 3,853,725. Nickel may be removed by liquid-liquid extraction or solvent extraction. See U.S. Pat. Nos. 4,162,296 and 4,196,076. Further, various phosphate type compounds have been used in the removal of nickel. See U.S. Pat. Nos. 4,162,296; 4,624,703; 4,718,996; 4,528,165; and 4,808,034.

It is known that metallic nickel, contaminated with fission products, can be decontaminated to remove any actinides present by direct electrochemical processing based on the differences in reduction potential in the electromotive force (emf) series. Actinides have a significantly higher reduction potential (than hydrogen) relative to nickel; therefore, actinides remain in solution while gaseous hydrogen is evolved by electrolysis of water. Consequently, actinides are normally won from molten salt electrolytes rather than from aqueous electrolytes. See U.S. Pat. No. 3,928,153 and 3,891,741, for example. Other electrolytic processes are disclosed by U.S. Pat. Nos. 3,915,828; 4,011,151; 4,146,438; 4,401,532; 4,481,089; 4,537,666; 4,615,776 and 4,792,385.

FIGS. 1 and 2 depict a conventional single electrowinning dissolution system and an entire plant layout, respectively. In FIG. 1 the contaminated metal first is dissolved in anodic dissolution tank 10. The contaminant-containing solution is then transferred out of the dissolving tank to oxidation tank 12, which is equipped with a dispersion system and optionally a blower 26, where the oxidation potential of the radiocontaminants is adjusted. Next, the solution is transferred from the oxidation tank to tank 14, which is equipped with a gas dispersion system and optionally a blower, where oxidants are removed from solution. Then, the solution is transferred through filter 16 which removes solids, and then through a series of ion exchangers 18,20 which remove the radiocontaminants from solution. Next, the solution is transferred to a series of holding tanks 22,24, and subsequently to an electrowinning plating cell (not shown) where nickel is cathodically plated.

FIG. 2 is a schematic representation of a full scale plant layout utilizing the dissolution system of FIG. 1. A series of dissolving tanks 100 (as described above) are serially connected to each other electrically (heavy lines) and via electrolyte piping (thin lines). The dissolving tanks are also connected to holding tanks 120,122 and electrolyte return tanks 130. The dissolving tanks are driven by power supplies 124. Upon dissolution, the solution is transferred to a series of electrowinning plating tanks 126, which are serially connected to power supplies 128, for cathodic deposition of nickel. Thus, while such electrowinning methods are generally effective, they are disadvantageous in that require the use of separate, multiple tanks and power supplies, with a concomitant high cost in capital and operating expense.

In addition, while the removal of uranium and other actinides has been generally addressed by electrowinning or electrorefining techniques, the removal of technetium has continued to be a problem. For example, when nickel is refined by standard electrorefining art in a sulfate electrolyte solution, the technetium had been found to track the nickel and codeposit on the cell cathode. Thus, e.g., experiments employing aqueous sulfuric acid solutions at a pH of about 1–4 at room temperature have shown that the technetium activity of the deposited metal may be as high as the technetium activity of the feedstock. Moreover, such methods require the use of large amounts of resin to remove the technetium. Consequently, a high volume of secondary waste is generated by efforts to remove technetium and other metal contaminants in addition to product recovery. Such problems have been addressed in part in U.S. Pat. Nos. 5,156,722, 5,183,541, and 5,262,019.

What is needed is a method which can effectively recover nickel from nickel contaminated with technetium, other transition metals, and actinide metals, which minimizes equipment requirements, operating costs, and capital costs.

There is a further need for an economical, energy efficient, easy-to-operate method to decontaminate radiocontaminated nickel and, more specifically, to separate technetium, neptunium, plutonium and uranium from nickel, which operates in an environmentally sound manner, and concentrates the contaminated material in a manageable, low volume waste stream.

There is also a need for a method for recovering technetium, other transition metals, and actinide metal contaminants from nickel which reduces the need for secondary processing means to separate/remove such contaminants from nickel, simplifies acid management, and reduces chemical consumption.

SUMMARY OF THE INVENTION

These and other needs are satisfied by the invention which is characterized by electrorefining nickel contaminated with radioactive contaminants in a unique combination of treatment steps. The methods of the invention are believed to be particularly effective in decontaminating nickel contaminated with neptunium, plutonium, uranium, and especially technetium.

Radioactive contaminants, including transition metals such as technetium, and actinide metals such as plutonium and uranium, will not cathodically codeposit with nickel under alkaline processing conditions. Accordingly, the electrorefining decontamination methods of the present invention, which may operate in a single electrochemical cell containing an alkaline electrolyte, allow substantially contaminant-free nickel to be selectively recovered from the electrolyte, even in the presence of radioactive contaminants.

In one preferred embodiment of the method of the invention, nickel is selectively recovered from an alkaline electrolyte by cathodically depositing substantially radiofree nickel from solution in an electrorefining cell containing a semi-permeable membrane. Preferably, the electrolyte is ammonium sulfate having a pH in the range of between about 10–13 and comprising from about 100 to 250 g/L sulfate. This embodiment of the invention eliminates the need for peripheral decontamination processes (such as those employing ion exchange/filtration means) to remove any radiocontaminants from the electrolyte in extraneous processing operations beyond the electrolytic cell. Therefore, the amount of ion exchange resin consumed and secondary wastes generated when removing technetium and other radiocontaminants under acidic plating conditions, are substantially reduced. In addition, acid management and pH control are simplified because the electrorefining methods of the present invention consume and generate acid in a single tank. Thus, a balanced pH can be readily maintained without the addition of substantial amounts of chemicals.

In another preferred embodiment of the method of the invention, the oxidation potential of the radioactive contaminants in solution is adjusted externally of the electrochemical cell to drive the radio-contaminants to a suitable oxidation state for removal in a subsequent step (rather than allowing for accumulation in the anolyte). Preferably, an oxidizing agent selected from the group consisting of hydrogen peroxide, ozone, oxygen gas, permanganate and a nitric acid-nitrous acid mixture, is added in an amount sufficient to oxidize the contaminants. Next, the radioactive contaminants are separated from the solution externally of the cell. Then, the nickel-containing solution is re-introduced into the cell to selectively recover nickel by cathodically depositing substantially radio-free nickel from the solution in the cell. In this preferred practice, the radio-activity of the nickel-containing solution may be verified after the separation step and before charging into the cathode chamber of the electrochemical cell. If the radioactivity of the solution is unacceptable, the solution is continuously recycled through the redox and contaminant polishing systems for further treatment, i.e., the oxidation potential of the solution is adjusted and the solution is passed through filtration and/or ion exchange means, until the solution is substantially free of radioactive contaminants. In preferred practice, the gross beta activity of the nickel-containing solution may be less than about 20 Bg/gm, and more preferably less than about 0.5 to 1 Bq/gm, after the separation step and prior to re-introduction into the cell.

Nickel electrorefined by practicing the methods of the invention should have a gross beta activity of less than about 1 to 10 Bq/gm, and technetium contamination levels of about 0.25 to 10 Bq/gm, preferably from 0.5 to 7 Bq/gm, more preferably from 0.5 to 1, or less. Alternatively, levels of radiocontamination should be reduced to environmentally acceptable values, typically less than about 10 ppb, preferably less than about 5 ppb, and even more preferably less than about 1 ppb, reaching European free-release levels at less than or equal to about 0.37 Bq/gm.

In practicing the electrorefining methods of the invention, it is essential that nickel is cathodically deposited in an alkaline electrolyte. As used herein, the term "alkaline" means an aqueous solution having more hydroxyl than hydrogen ions, i.e., a solution having a pH above 7. Substantially contaminant-free nickel may be recovered at the cathode if the electrolytic solution is maintained at a pH above 7, preferably in the range between about 8 to 14, more preferably between about 10 to 13, and even more preferably between about 10 to 12. That is, when the electrolytic solution is maintained at such pH levels, it is believed that transition and actinide metal contaminants do not track nickel to the cathode, and will not reduce chemically with the cathodic nickel product. Since technetium and other contaminants remain in solution during the course of the treatment, substantially contaminant-free nickel may be recovered in a single step.

Advantageously, when practicing the methods of the invention, the dissolving and plating operations may occur in a single electrochemical cell which is driven by a common current and controlled by a single rectifier. Since the entire process may be undertaken in a single cell, the number of electrochemical cells, processing tanks, and electrical hardware including power supplies and rectifiers, required for practicing the methods of the invention is reduced by up to about one half or more. Likewise, current consumption is decreased by about 50% or more compared to the electrowinning methods of the art. Consequently, operating costs and capital investment also are reduced.

Accordingly, it is a object of this invention to provide a method for selectively recovering nickel from radiocontaminated nickel which reduces the operating cost of prior nickel decontamination systems, is simple and easy to operate, and allows the beneficial reuse of nickel metal.

It is yet another object of this invention to provide a method for electrorefining radio-contaminated nickel which selectively plates nickel in the presence of transition metal contaminants such as copper, iron, and technetium, and radioactive metal contaminants such as neptunium, plutonium and uranium.

BRIEF DESCRIPTION OF THE DRAWINGS

The present invention may be more fully understood by reference to the accompanying drawings, which are offered by way of example only, wherein.

DETAILED DESCRIPTION OF THE INVENTION

Figure 1:
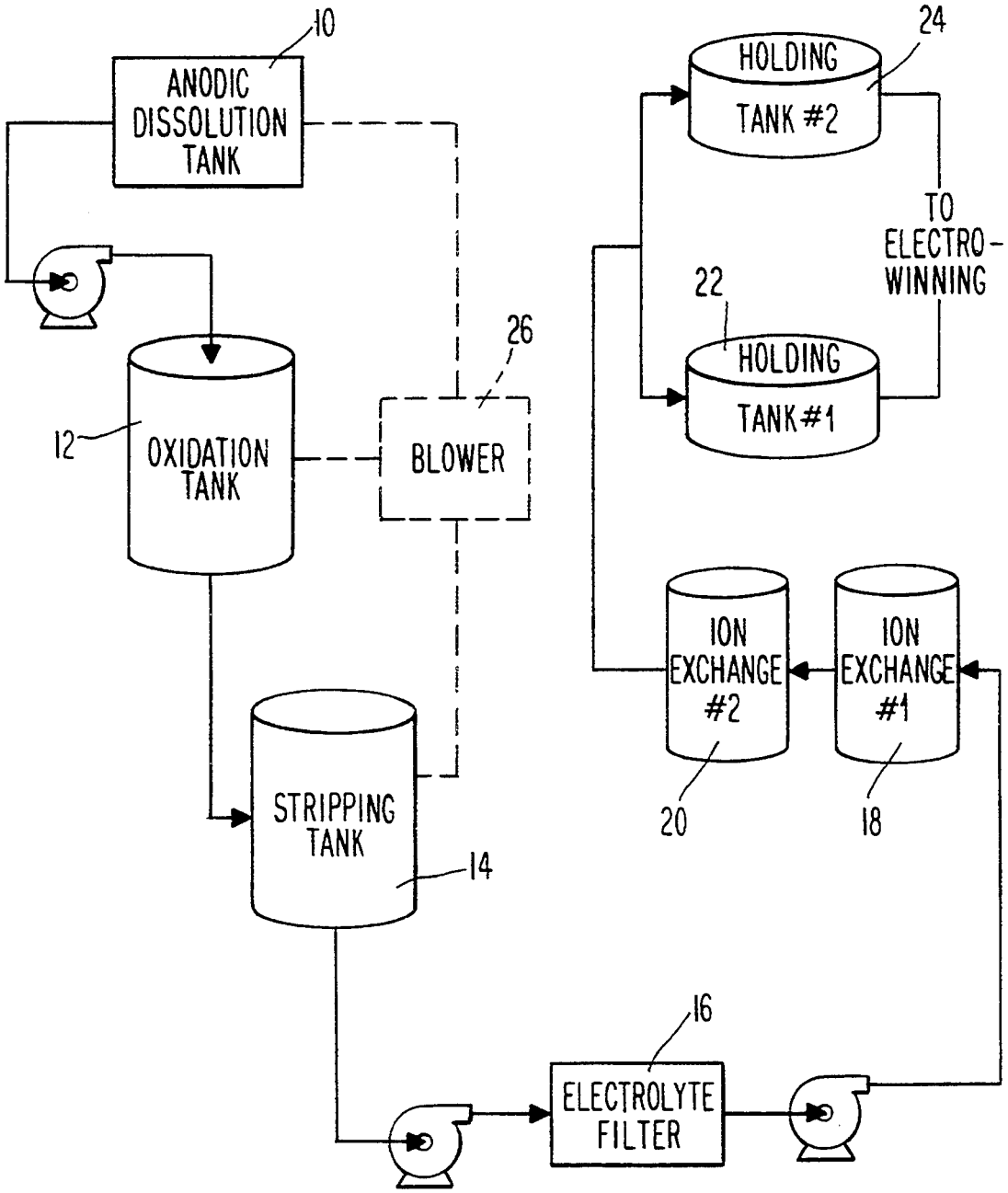
FIG. 1 is a schematic representation of a dissolution system for practicing an electrowinning process to plate nickel.
Figure 2:
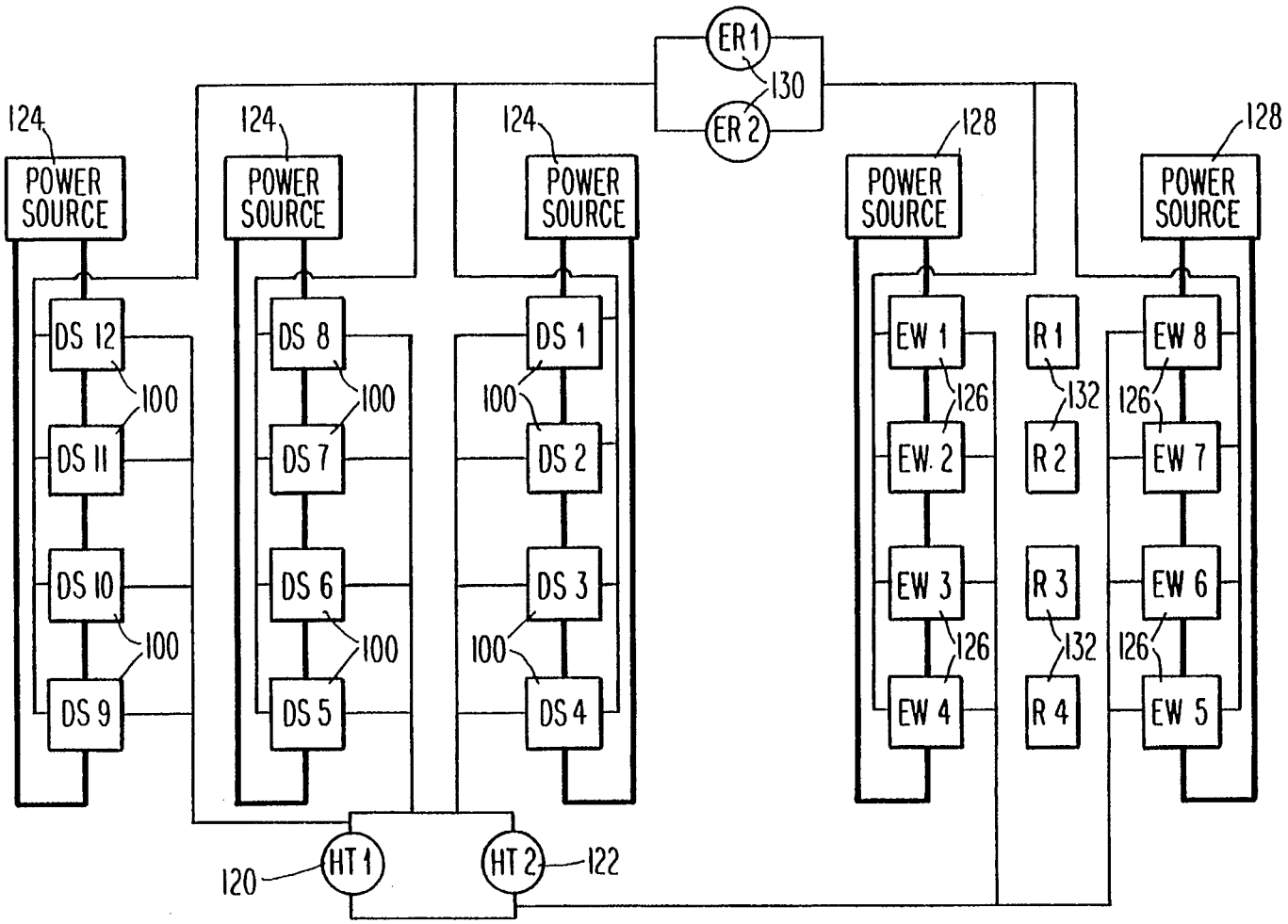
FIG. 2 is a schematic representation of a plant layout for practicing an electrowinning process to plate nickel, using a series of dissolution systems depicted in FIG. 1.
Figure 3:
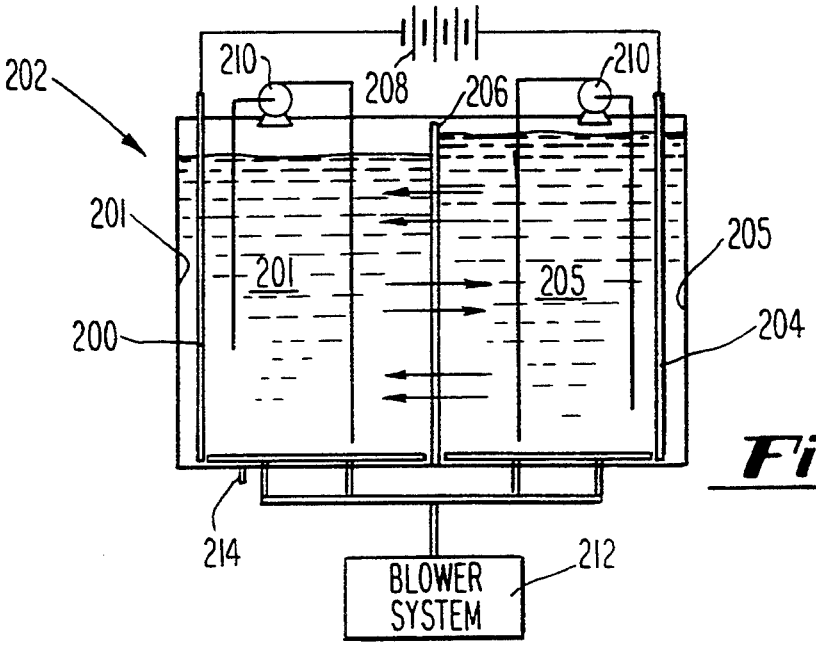
FIG. 3 is a schematic representation of an apparatus and an abbreviated flow diagram of an embodiment of the process employed in the practice of the present invention.

The methods of recovering nickel in accordance with the invention are illustrated in the accompanying drawings. Referring now to FIG. 3, the electrorefining electrochemical cell 202 has an anode 200 in an anode chamber 201 and a cathode 204 in a cathode chamber 205 which may be electrically connected by a voltage source 208 and controlled by a single rectifier (not shown). The anode chamber 201 and the cathode chamber 205 are separated by a semi-permeable membrane 206 which permits the transfer of the electrolytic solution from one chamber to the other, and completes the electrical circuit. The semi-permeable membrane may be comprised of any material which permits ionic flow, but prohibits bulk or osmotic flow, between anode chamber 201 and cathode chamber 205. Such materials are well known to those skilled in the art. Preferred materials include polymers such as polysulfone, sintered glass frit, and finely powdered ceramic particles compressed between porous membranes. The cell 202 may have a drain line 214 for removing anodic slimes, including technetium oxide, which form in the anode chamber. The cell may also be equipped with a blower 212 for agitation and/or aeration of the solution.

The anode 200 is normally comprised of the metal to be recovered at the cathode 204. The nickel to be decontaminated is generally available in the form of 24 inch diameter by 18 inch high 2,200 pound ingots, which must be converted to anodes having a much higher surface area per unit weight geometry for effective electrolytic dissolution. Preferably, the electrode preparation involves a minimum amount of reprocessing, product losses and waste generation. Accordingly, contaminated anodes are preferably prepared by "shot" production or thin sheet rolling from contaminated ingots. Methods for preparing such electrode are described in U.S. Pat. No. 5,262,019, issued Nov. 16, 1993, in the name of Snyder et al., the disclosure of which is incorporated herein by reference in its entirety. Alternatively, the contaminated anode may be in powder or bar form.

The cathode employed to practice the methods of the invention may be comprised of one or more materials selected from the group consisting of titanium, platinum, stainless steel, graphite and nickel. Nickel is preferred.

The electrochemical cell typically operates at between about room temperature (approximately 20° C.) and 75° C., preferably between about 35° and 75° C., and more preferably between about 40° and 60° C., and at a current density of about 10 to 300 amps/square foot with an efficiency of about 80% or more at a cell voltage of about 1 to 4 volts/cell. The cell may be operated at between about 1 to 5 volts/cell, preferably at about 1 to 3 volts/cell.

The electrochemical cell 202 advantageously may employ any suitable aqueous solution having a pH of above 7 as an electrolytic solution, including for example, ammonium sulfate, ammonium chloride, ammonium hydroxide, ammonium carbonate, with ammonium sulfate being preferred. Initially, the contaminated anode may be dissolved in an acidic solution of, say for example, sulfuric or hydrochloric acid, having a pH of between about 1 to 3, and a temperature of between about 30° to 70° C. The amount of anion in solution is not critical, as long as there is a sufficient amount to support nickel dissolution. Preferably, the electrolyte contains from about 100 to 250 g/L sulfate (as sulfate, $SO_4^=$), and more preferably from about 145 to 245 g/L sulfate, added as sulfuric acid ($H_2SO_4$). Next, a balancing cation may be added to the solution in an amount sufficient to increase the pH of the electrolyte to the desired alkaline range. Preferably, the pH of the electrolyte is adjusted by adding at least one cation selected from the group consisting of ammonium, sodium, calcium, or the like, with ammonium being preferred. For example, the pH of the electrolyte may be adjusted by adding sodium hydroxide, calcium hydroxide, and/or by sparging with $NH_3$. Alternatively, the contaminated anode may be placed directly in an alkaline solution having the appropriate pH.

The alkaline electrolyte may contain at least about 30 g/L and up to about 280 g/L nickel. Preferably, the alkaline electrolyte contains from about 60 to 130 g/L, and more preferably about 70 to 100 g/L nickel. The alkaline electrolyte may also contain up to about 30 g/L boric acid, which functions to improve the plating rate and the character of the plating deposition. When practicing this embodiment of the invention, the pH of the catholyte may be somewhat higher than the pH of the anolyte, whereas the concentration of nickel in the catholyte is slightly lower.

Other electrolytes, such as fluoroboric acid, fluorosilicic acid, hydrochloric acid, nitric acid and the like, and other suitable process conditions may be employed in other practices of the present invention, as long as such materials and process conditions support nickel plating, are compatible with the cellular construction materials, and do not substantially increase the amount of secondary waste generated. The alkaline electrolyte may have a gross beta activity of more than about 2000 to 6000 Bq/gm, prior to treatment.

In the preferred embodiment of the method of the invention depicted in FIG. 3, the solution is circulated within cell 202 between chambers 201 and 205. In practicing this particular embodiment, the alkaline solution in the cathode chamber 205 may be maintained at a slighter higher pressure, say from about 1 to 1.2 atm, to promote flow/transfer of the alkaline solution from the cathode chamber to the anode chamber to dissolve additional contaminated nickel. The alkaline solution in electrochemical cell 202 also may be recirculated by pumps 210 which may be equipped with carbon filters (not shown) for removing organics and other particulates in the solution. In addition, a blower device 212 may be utilized for cell agitation and aeration.

Any unprecipitated contaminant remains in solution, accumulating in the anolyte which is periodically removed and treated. Any precipitated contaminant, such as technetium oxide, generally reports to the anodic slimes which may be periodically removed from the cell, treated and buried. For example, recirculating carbon beds may be placed in both the anolyte and catholyte chambers to receive hydrocarbon and radiocontaminants. Thus, there is no requirement for any separate processing step using ion exchange means or solvent extraction to remove the radioactive contaminants, and any process step to separate the radioactive contaminants from the nickel-containing solution external to the electrochemical cell is optional. As a result, low volumes of waste are generated.

Figure 4:
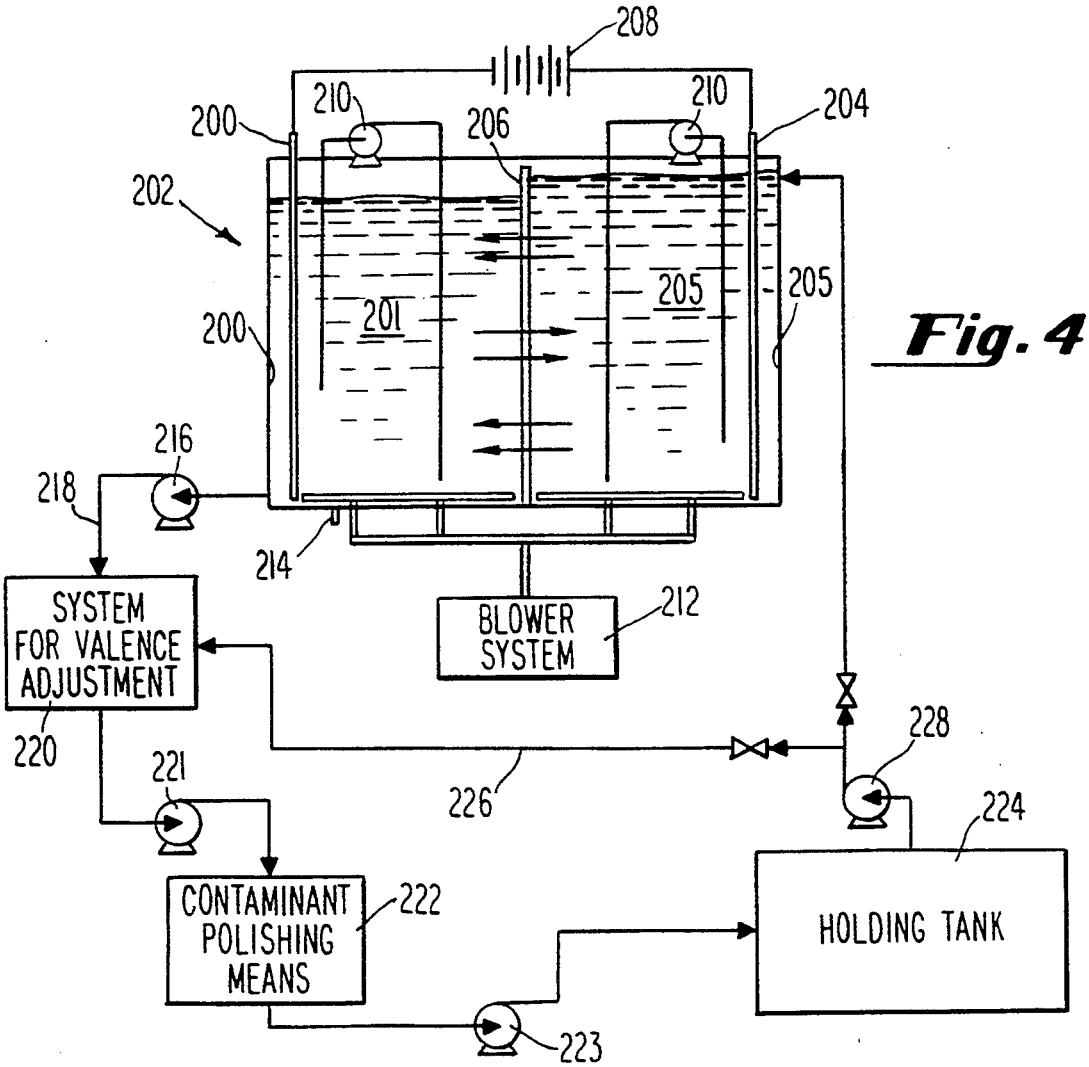
FIG. 4 is a schematic representation of an apparatus and an abbreviated flow diagram for an alternate embodiment of the process employed in the practice of the present invention.

In another embodiment of the method of the invention, substantially radio-free nickel is electrorefined at the cathode by controlling pH and adjusting the oxidation potential of the radioactive contaminants in a separate step which occurs externally of the electrochemical cell. This embodiment is particularly adapted to remove trace amounts of radioactive-containing species from the nickel-containing solution prior to the deposition of nickel in the cathode chamber. In such an alternative embodiment of the method of the invention, which is shown in FIG. 4, the solution may be circulated through an external circuit from the anode chamber 201 to the cathode chamber 205 and then back to the anode chamber 201 through the membrane 206. The composition of the electrolyte solution and operating conditions of the electrolytic cell generally are as described above.

The contaminate-containing solution in the anode chamber 201 is pumped from the electrochemical cell 202 (via pump 216) in an external line 218 into a vessel 220 where the oxidation/reduction potential of the radioactive contaminants in solution may be adjusted. Preferably, the contaminate-containing solution is contacted with an oxidizing agent which oxidizes the contaminants to a valence state where the contaminants may be readily precipitated and removed from solution in later processing steps. Preferably, the radiocontaminant-containing solution is contacted with an oxidizing agent selected from the group consisting of hydrogen peroxide, ozone, oxygen gas, nitric acid-nitrous acid mixtures, and permanganate. Preferably, oxidizing agents such as peroxide and ozone are used to oxidize any technetium species in the alkaline solution to technetium (+7). Depending upon the oxidizing agent, any unreacted oxidizing agent remaining in solution after the oxidation step, may be removed to protect downstream filters and ion exchangers from possible oxidation. In those practices where ozone is employed as an oxidizing agent, air or steam is preferably employed to strip the ozone from the alkaline solution following the oxidation step. In practices where hydrogen peroxide is employed as the oxidizing agent, ion exchange "blocking" may be used to remove residual impurities.

Following the oxidation adjustment (or redox) step, the nickel-containing solution may be pumped (via pump 221) through a contaminant polishing means 222, which may consist of, for example, a filtering means and/or an ion exchange means, for removing contaminants from the solution. For example, the nickel-containing alkaline solution may be filtered through a particulate filter to separate particulates from the alkaline solution. The particles may be colloidal sized particles stemming from the contaminant metal itself (such as technetium oxide) or processing contaminants such as resin fragments or the like. Preferably, the filter is a hybrid sand-powdered ion exchange resin filter. Alternatively, or in addition to the filtration step, the alkaline solution may flow through one or more ion exchangers having an anionic or mixed resin bed, for sorbing cationic technetium complexes and other radioactive/transition/actinide metal ions. Preferably, resins are employed at an operating temperature of less than about 60° C. Mixed ion exchangers may be employed to eliminate the effects of any localized pH variations that may occur in a pure anion column and which may be deleterious to the reaction.

Preferably, at least two ion exchangers are employed on-line in series. Each on-line ion exchanger is monitored to determine radiochemical activity breakthrough. When the first (i.e., the upstream) ion exchanger bed in tandem breaks through, it is taken off-line and regenerated while the second bed in tandem is "moved-up" to the first position and a fresh bed is installed in the second position.

If desired, after the contaminant polishing step and before the alkaline solution is reintroduced into the cathode chamber, the solution may be pumped to one or more holding tanks 224, where the contamination level/activity of the alkaline solution may be monitored so that an excessively contaminated alkaline solution is not fed into the cathode chamber. If the contaminant level or radioactivity of the alkaline solution is too high, say above about 40 ppb or 75 Bq/gm, the alkaline solution may be recycled via a pump 228 in an external line 226 to upstream of the redox vessel. Preferably, the recycled solution is returned to the vessel 220 for adjusting its oxidation potential to assure, for example, complete oxidation of technetium to the technetium +7 species. The oxidation/reduction and contaminant polishing steps may be repeated until the desired level of contaminant has been removed. When the contaminant/activity level of the alkaline solution is considered acceptable, the nickel-containing alkaline solution may be reintroduced to the cathode chamber of the electrorefining electrochemical cell.

The invention is further illustrated by the following examples which are not intended to be limiting.

EXAMPLES

A solution containing about 90 g/L of nickel and 5.4 mg/L of uranium was plated under the operating conditions set forth in Table 1. Results are set forth in Table 2.

During Experiments 1 and 2, which were conducted in an acidic electrolyte, the seed cathode surfaces were passivated by oxidation when the cathodes were removed from the bath to establish the weight gain, rendering the cathodes substantially inoperable for additional runs. Electrode passivation did not occur during Experiments 3 and 4 which were conducted in an alkaline electrolyte. As the data for Experiments 3 and 4 indicates, over 99% of the nickel was recovered by cathodic deposition in an alkaline electrolyte. The purity of the recovered nickel was not analyzed.

TABLE 1

| | TEST CONDITIONS | | |
|---|---|---|---|
| NUMBER | ANODE | CATHODE | pH |
| 1 | GRAPHITE | STAINLESS | ACIDIC |
| 2 | INERT | NICKEL | ACIDIC |
| 3 | GRAPHITE | STAINLESS | BASIC |
| 4 | INERT | NICKEL | BASIC |

TABLE 2

| RESULTS BASIC TESTING - EXPERIMENTS 3 AND 4 | | | | |
|---|---|---|---|---|
| | U mG/L | Ni mG/L | EFF. % | NITRATE G/L |
| TEST 3 | 5.4 | 24 | 99.5 | 157 |
| TEST 4 | 5.4 | 12.5 | 99.8 | 194 |

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than by the foregoing description, and all changes which come within the meaning and range of equivalency of the claims are intended to be embraced therein.

We claim:

1. A method for decontaminating radiocontaminated nickel comprising, in an electrorefining cell having a semi-permeable membrane, cathodically depositing substantially radio-free nickel from an alkaline solution containing electrolyte, nickel ions, and radioactive ions; wherein said solution is maintained at a pH of at least about 10 (as measured at the cell temperatures, and wherein said radioactive contaminant is at least one contaminant selected from the group consisting of the transition and actinide metals.

2. The method of claim 1 wherein the electrodes of said cell are driven by a common current and controlled by a single rectifier.

3. The method of claim 1 wherein said contaminant is selected from the group consisting of technetium, neptunium, plutonium and uranium.

4. The method of claim 3 wherein said contaminant is technetium.

5. The method of claim 1 wherein said electrolyte has a pH in the range of between about 10 to 13.

6. The method of claim 5 wherein said electrolyte is selected from the group consisting of ammonium sulfate, ammonium chloride, and ammonium hydroxide.

7. The method of claim 6 wherein said electrolyte is ammonium sulfate.

8. The method of claim 7 wherein said electrolyte comprises from about 100 to 250 g/L sulfate.

9. The method of claim 1 further comprising the steps of:

a. adjusting the oxidation potential of the radioactive contaminants in said solution externally of said electrochemical cell;

b. separating said radioactive contaminants from said nickel-containing solution externally of said cell; and then c. re-introducing said nickel-containing solution into said cell to selectively recover nickel, by cathodically depositing substantially radio-free nickel from said solution in said cell.

10. The method of claim 9 where the oxidation potential of said contaminants is adjusted by adding oxidizing agent selected from the group consisting of hydrogen peroxide, ozone, oxygen gas, nitric acid-nitrous acid mixture, and permanganate.

11. The method of claim 9 wherein, before said solution passes is re-introduced into said electrolytic cell, steps (a) and (b) are repeated until said solution is substantially free of contaminants.

12. The method of claim 9 wherein said contaminants are selected from the group consisting of the transition metals.

13. The method of claim 12 wherein said contaminant is technetium.

14. The method of claim 9 wherein said solution has a pH in the range of between about 10 to 13.

15. The method of claim 9 wherein the electrodes of said cell are driven by a common current and controlled by a single rectifier.

16. The method of claim 1 wherein said electrolyte is maintained at a temperature of between about 40° and 60° C., and said cell is operated at a current density of about 10 to 300 amps/square foot with an efficiency of about 80% or more at a cell voltage of about 1 to 4 volts/cell.

17. A method for electrorefining nickel contaminated with radioactive contaminants, comprising the steps of:

a. first dissolving nickel metal contaminated with radioactive metal contaminants into an acidic solution having a pH between about 1 to 3 in an electrolytic cell containing a semi-permeable membrane, to produce a solution containing nickel ions and radioactive ions;

b. then raising the pH of the solution in said cell to at least about 8; and c. selectively recovering nickel from said solution by cathodically depositing substantially radio-free nickel from said solution in said cell.

18. A method for electrorefining nickel contaminated with radioactive contaminants, comprising the steps of:

a. dissolving nickel metal contaminated with radioactive metal contaminants into alkaline electrolyte in an electrolytic cell containing a semi-permeable membrane, said electrolyte having a pH in the range of between about 10 to 13, to produce a solution containing nickel ions and radioactive ions; and b. selectively recovering nickel from said solution by cathodically depositing substantially radio-free nickel from said solution in said cell.

19. The method of claim 18 wherein steps (a) and (b) are driven by a common current and controlled by a single rectifier.

20. The method of claim 18 wherein said contaminant is selected from the group consisting of technetium, neptunium, plutonium and uranium.

* * * * *